US005102132A

United States Patent [19]

Chen

[11] Patent Number: 5,102,132

[45] Date of Patent: Apr. 7, 1992

[54] PROTECTIVE ASSEMBLY FOR TENNIS RACKETS

[76] Inventor: Dennis Chen, No. 77, PO AI Road, Fengyuan, Taichung County, Taiwan

[21] Appl. No.: 689,639

[22] Filed: Apr. 23, 1991

[51] Int. Cl.[5] ..... A63B 49/14

[52] U.S. Cl. ..... 273/73 R; 273/73 D

[58] Field of Search ..... 273/73 R, 73 C, 73 D

[56] References Cited

U.S. PATENT DOCUMENTS

| | | | |
|---|---|---|---|
| 4,697,811 | 10/1987 | Muroi | 273/73 D |
| 4,744,562 | 5/1988 | Awano | 273/73 D |
| 4,776,592 | 10/1988 | Unlauft et al. | 273/73 D |
| 4,858,928 | 8/1989 | Muroi et al. | 273/73 D |

FOREIGN PATENT DOCUMENTS

| | | | |
|---|---|---|---|
| 2582528 | 10/1986 | France | 273/73 C |

*Primary Examiner*—William H. Grieb
*Assistant Examiner*—Raleigh W. Chiu

[57] ABSTRACT

The protective assembly for tennis racquets of the present invention comprises an elastic holder strip and a pair of protective elements. The holder strip is pre-formed in an open oval shape so as to be easily wrapped over the headframe of a tennis racquet. A guide bar of open rectangular cross-sectional shape extends along the length of said holder strip with a pair of parallel walls on whose respective upper edges are formed a respective pair of wings extending laterally and downward therefrom. A plurality of string guides with axial holes are formed on the lower base of the guide bar extending inwards perpendicularly therefrom. The holder strip is wrapped over the headframe of a tennis racquet with the string guides inserted through the through-holes therein and the headframe threaded with string, passing through the axial holes of the string guides to form a net over the headframe. The two wings of the guide bar overhang a portion of the outer peripheral wall of the headframe to define a pair of reentrant cavities. The inner sides of the two protective elements, on which are formed enlarged buttress sections, are then squeezed and inserted into respective cavities to secure the protective elements in place. The outer sides of the protective elements extend to respective edges of the headframe's outer periphery. Protective elements of different weight can be exchanged to alter the weight of the racket.

5 Claims, 3 Drawing Sheets

PROTECTIVE ASSEMBLY FOR TENNIS RACKETS

BACKGROUND OF THE PRESENT INVENTION

The present invention relates to a protective assembly for tennis rackets and more particularly to a protective assembly for tennis rackets that can be used to adjust the weight of the racket and that can be easily removed or exchanged without the need for restringing the racket.

Through protective rims that can be used to adjust the weight a racket have been previously offered, they suffer from the fact that the headframe must first be unstrung before the protective rim is removed. As an example from the prior art, refer to FIGS. 1 and 2 of the drawings.

The protective rim comprises a cover 6 with a recessed guide 61 formed along its center, between two outer sides 62*a* and 62*b*, and a holder strip 5 with a plurality of string guides 4 formed on its lower surface.

The outer periphery of headframe 1 has a centrally disposed recessed channel 2 with a plurality of threading holes 3*a* formed thereon. The inner periphery of headframe 1 has a matching set of threadholes 3*b* .

To secure the protective rim, the string guides 4 of holder strip 5 are first passed through holes 61*a* of cover 6 and then inserted through corresponding threadholes 3*a* and 3*b* headframe 1, with holder strip 5 resting inside groove 61.

A string is then threaded through axial holes 41 formed in each string guide 4 to string headframe 1 in the conventional manner to form a net thereon. This also secures holder strip 5 and cover 6 to the outer periphery of headframe 1.

Through cover 6 gives ample protection to the outer preiphery of headframe 1 and covers of different thickness can be used to adjust the weight of the racquet, holder strip 5 must first be removed in order to exchange for a new cover. This of course requires headframe 1 to be first unstrung, a laborious and time consuming task requiring the aid of a stringing machine.

Moreover, the racquet must be subsequently restrung to secure the new cover. Repeated stringing and unstinging of the racket places undue stress on the headframe and eventually will cause cracks to occur near the threadholes, curtailing the service life of the racket.

The improved protective assembly of the present invention provide a user with the ability to change protective assembly without the need for unstringing of his or her racket or the need for extraneous tools.

A full and detailed description of the protective assembly of the present invention and its use is given below.

SUMMARY OF THE PRESENT INVENTION

The protective assembly for tennis racquets of the present invention has as a main objective to a provide protective assembly for tennis racquets that can be used to adjust the weight of the racket and that can be easily removed and replaced, without the need for unstringing the racquet. The weight adjusting protective assembly for tennis racquets of the present invention comprises two protective elements disposed between a headframe and a holder strip.

The holder strip is pre-formed in an open oval shape so as to be easily wrapped over the headframe of a tennis racquet. A guide bar of open rectangular cross-sectional shape extends along the length of said holder strip and has a pair of parallel walls joined at the lower edges thereof by a base. A pair of wings extend laterally and downward from the upper edges of the respective parallel walls. A plurality of string guides with axial holes are formed on the lower base of the guide bar extending inwards perpendicularly therefrom.

The holder strip is wrapped over the headframe of a tennis racquet with the string guides inserted through the through-holes therein and the headframe threaded with string, passing through the axial holes of the string guides to form a net over the headframe. Note that as the holder strip is pre-formed to approximately the shape of the headframe, this operation can be accomplished with a minimum of fuss.

The two wings of the guide bar overhang a portion of the outer peripheral wall of the headframe to define a pair of reentrant cavities. An arcuate, enlarged buttress section having the same cross-sectional shape as the reentrant cavities are formed on the inner sides of the two elongate covers. The outer sides of the top covers which have a thinner section extend to respective edges of the headframe's outer periphery to protect the entire rim thereon.

The protective elements can be easily extracted and replace with new protective elements of different weight so as to adjust the weight of the racquet. No unstringing of the racket or removal of the holder strip is required. The main objective of the present invention is thus clearly attained.

A detailed description of the protective assembly of the present invention along with its further advantages are given in the embodiment below.

PREFERRED EMBODIMENT OF THE PRESENT INVENTION

Figure 1:
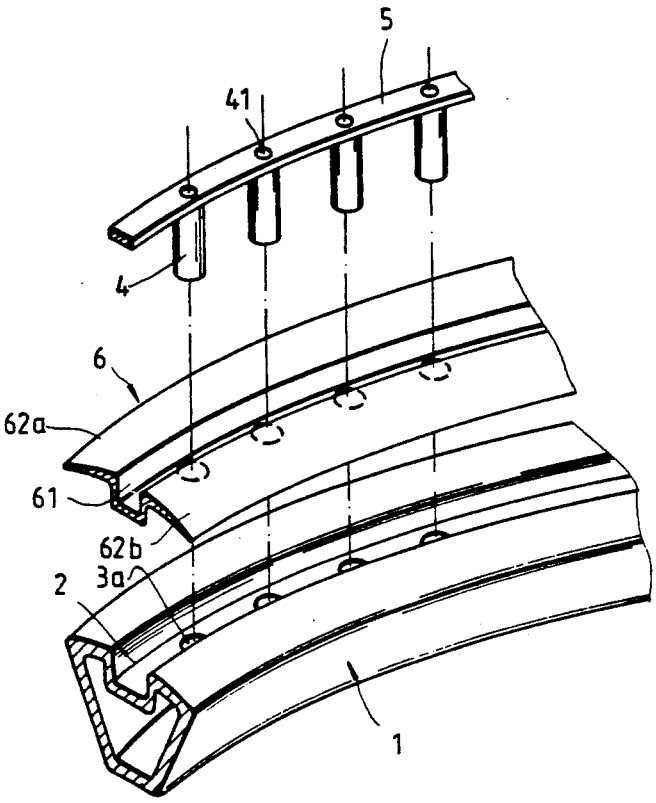
PRIOR ART FIG 1
FIG. 1 is a sectional exploded view of a protective assembly and head frame of a tennis racket of the prior art.
Figure 2:
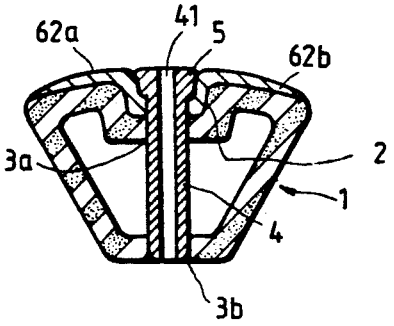
PRIOR ART FIG 2
FIG. 2 is a cross-sectional view of a protective assembly and head frame of a tennis racket of the prior art.
Figure 3:
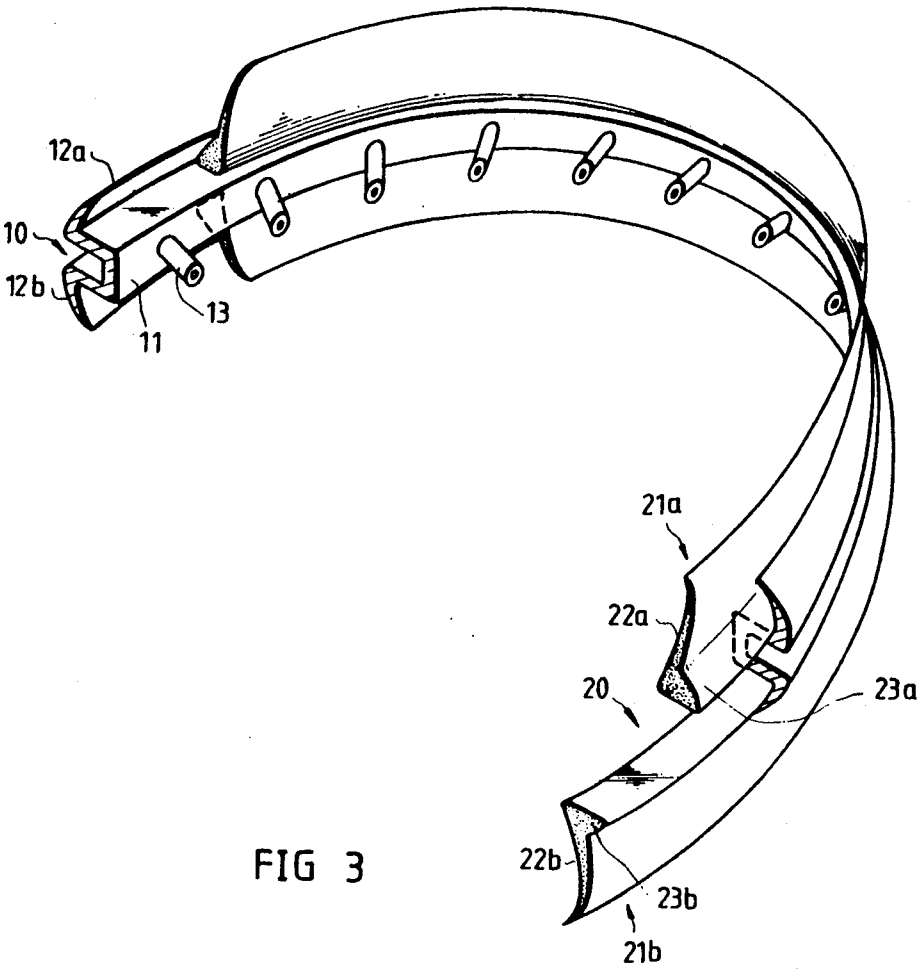
FIG. 3 is a perpective cut-way view of the protective assembly of the present invention placed within a mounting string holder.

The weight adjusting protective assembly 20 for tennis racquets of the present invention comprises an arcuate holder strip 10, and two protective elements 21*a*, 22*a*, as shown in FIG. 3.

Holder strip 10 is made from an elastic plastic material and formed in the shape of an open oval, approximating the oval shape of a tennis racket's head frame.

A recessed, guide bar 11 is formed along the arcuate periphery of holder strip 10, in a medial position between a pair of symmetrical retainer wings 12*a* and 12*b* formed on the respective upper and lower sides thereof.

Figure 5:
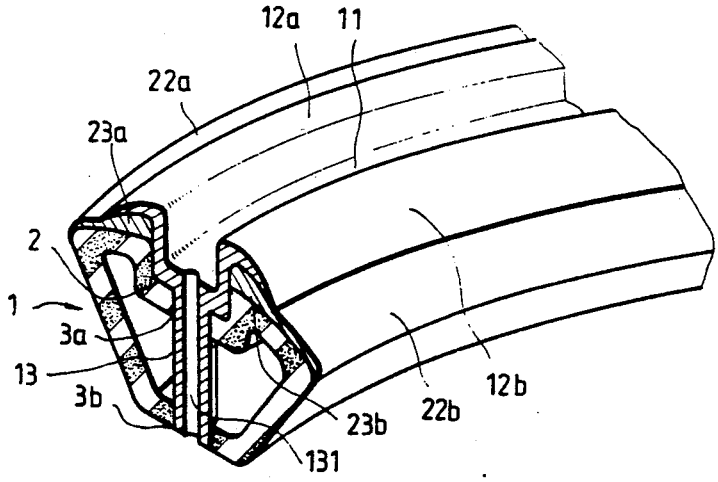
FIG. 5 is a perspective sectional view of a string holder and protective assembly of the present invention secured to the head frame of a racquet.

In cross-section, guide bar 11 is open rectangular in shape, with arcuate downward sloping retainer wings 12*a* and 12*b* extending laterally from the top of respective parallel sidewalls of guide bar 11, as shown in FIG. 5.

A plurality of string guides 13 are formed along the inner periphery of holder strip 10 on the lower base of guide bar 11, extending perpendiculary inwards therefrom. The number and inter-guide spaceing of string guides 13 corresponds with the number and spacing of through-holes 3*a* and 3*b* on headframe 1, shown in cross-section in FIG. 4. The diameters of through-holes 3*a* and 3*b* are also equal with the outer diameter of string guides 13.

The protective assembly 20 which is made from pliant, elastic plastic comprises two elongate and symmetrical elements 21*a* and 21*b*.

In cross-section, both elements 21*a* and 21*b* have respective arcuate, outer sides 22*a* and 22*b*. Both outer sides 22*a* and 22*b* taper gradually in thickness from the outer edges thereof to a respective enlarged, inner buttress section 23*a* and 23*b* formed on the inner sides of respective covers 21*a* and 21*b*.

The arcuate, cross-sectional shape of buttress sections 23*a* and 23*b* conforms with the shape of the arcuate lower sides of retainer wings 12*a* and 12*b*, as shown in FIG. 5.

Figure 4:
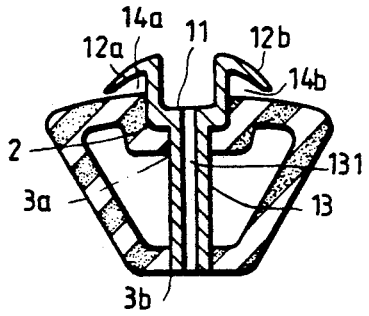
FIG. 4 is a cross-sectional view of a string holder used in the presnet invention mounted onto the headframe of a tennis racquet.

Referring to FIGS. 4 and 5, in actual use, the holder strip 10 is first wrapped over a head frame 1 of a tennis racquet and string guides 13 inserted through corresponding through-holes 3*a* and 3*b* in head frame 1, with guide bar 11 enscounced within a conformingly shaped recessed channel 2 formed therein.

A string is then threaded through axial holes 131 formed within each string guide 13 to form a net over the headframe 1 according to conventional fashion. The tension in string tightly secures holder strip 10 to head frame 1.

The two elements 21*a* and 21*b*, being soft and pliable, can then be squeezed and inserted into respective reentrant cavities 14*a* and 14*b* defined by the lower surface of respective retainging wings 12*a* and 12*b* and the outer periphery of head frame 1. Buttress sections 23*a* and 23*b* fit within respective reentrant cavities 14*a* and 14*b*, having the same arcuate shape as the lower surface of retainer wings 12*a* and 12*b*.

The two outer sides 22*a* and 22*b* of respective elements 21*a* and 21*b* extend to cover respective edges of head frame 1 to protect the entire outer periphery thereof.

Note that the protective assembly 20 can be made in various colors to compliment the esthetics of a tennis racquet or be used as a form of color coding by a user to differentiate from among different racquets that might otherwise have identical outward appearances.

More importantly, by offering protective elements 21*a*, 21*b* which have outer sides 22*a* and 22*b* of differing thickness respectively, or that have various apertures formed thereon, the weight of a racquet can be selectively varied by a user by the simple expedient of exchanging the protective assembly 20 on his or her racquet. This can be achieved without the tedious and laborious task of first having to unstring the racquet and removing the holder of the protective rim as is the case with protective rims of the prior art.

Moreover, as holder strip 10 is pre-formed to the approximate shape of head frame 1, a user does not have to exert a large force to bend holder strip 10 over head frame 1 while gingerly attempting to insert string guide 13 therein, as would be the case for an essentially linear holder strip.

I claim:

1. A protective assembly for a head frame of a tennis racquet comprising an arcuate holder strip and a pair of elongate protective elements made from a pliant, elastic material, wherein:

said holder strip is pre-formed in an open oval shape roughly equal in shape and size with a headframe of a tennis racquet;

a guide bar with an open outer periphery is formed along the length of said holder strip, with a pair of wings extending symmetrically and in a substantially lateral direction to the left and right respectively, from the top of a respective left side wall and right side wall of said guide bar;

a plurality of string guides are formed on the lower base of said guide bar, extending inwardly at a perpendicular angle therefrom, with the number and spacing between adjacent said string guides corresponding with the number and spacing of through-holes on said head frame;

whereby, said holder strip is wrapped over said headframe and said string guides inserted through said through-holes on said headframe, with said guide bar resting inside a recessed channel extending around the outer periphery of said headframe, and said headframe threaded with a string passing through axial holes formed in each said string guide on said holder strip to form a net over said headframe and thereby tightly securing said holder strip to said headframe, said pair of wings of said holder strip overhangs a respective portion of the outer peripheral wall of said headframe to define a respective left and right cavity along the outer periphery of said headframe, above and to either side of said guide bar;

the inner sides of respective said pair of protective elements are squeezed and inserted into respective said cavities along the outer periphery of said headframe to releasably secure said pair of protective elements to said headframe, the outer sides of respective said pair of protective elements extending to respective outer edges around said headframe to protect the entire outer periphery thereon.

2. A protective assembly for tennis racquets according to claim 1, wherein:

said laterally extending pair of wings of said holder strip slope downwards to form a pair of respective reentrant shaped said cavities;

an enlarged buttress section is formed along each said inner side of respective said pair of protective elements, with a shape conforming with said reentrant shape of said cavities, the remaining outer sides of each said pair of protective elements, extending to said outer edges of said headframe, have a thinner section;

whereby, respective reentrant shaped said cavities provided a more secure hold on squeeze inserted said buttress section of respective said covers.

3. A protective assembly for tennis racquets according to claim 2, wherein: said pair of protective elements are manufactured in different weights by varying the thickness of said outer sides of said protective elements so as to enable a user to adjust the weight of his or her racquet by selecting said pair of protective elements of selected pre-determined weight for insertion into said cavities between said holder strip and said headframe.

4. A protective assembly for tennis racquets according to claim 3, wherein:

said pair of protective elements are manufactured in different weight by adding one or more apertures to said outer sides of said protective elements so as to enable a user to adjust the weight of his or her racquet by selecting said pair of protective elements of selected pre-determined weight for insertion into said cavities between said holder strip and said headframe.

5. A protective assembly for tennis racquets according to claim 1, wherein:

said pair of protective elements are manufactured in different colors to compliment the esthetic quality of a tennis racquet and aid a user in differentiating from among different racquets.

* * * * *